US009876274B2

(12) United States Patent
Kim et al.

(10) Patent No.: US 9,876,274 B2
(45) Date of Patent: Jan. 23, 2018

(54) ANTENNA RADIATOR HAVING HETEROGENEOUS ANTENNAS CROSS-LINKED WITH EACH OTHER AND MANUFACTURING METHOD THEREFOR

(71) Applicant: Jae Beom Kim, Seoul (KR)

(72) Inventors: Jae Beom Kim, Seoul (KR); Sung Woo Bang, Seoul (KR)

(73) Assignee: Jae Beom Kim, Seoul (KR)

( * ) Notice: Subject to any disclaimer, the term of this patent is extended or adjusted under 35 U.S.C. 154(b) by 0 days.

(21) Appl. No.: 15/123,249

(22) PCT Filed: Mar. 28, 2014

(86) PCT No.: PCT/KR2014/002694
§ 371 (c)(1),
(2) Date: Sep. 2, 2016

(87) PCT Pub. No.: WO2015/133675
PCT Pub. Date: Sep. 11, 2015

(65) Prior Publication Data

US 2017/0062907 A1 Mar. 2, 2017

(30) Foreign Application Priority Data

Mar. 4, 2014 (KR) ..... 10-2014-0025698

(51) Int. Cl.
*H01Q 1/24* (2006.01)
*H01Q 1/38* (2006.01)
(Continued)

(52) U.S. Cl.
CPC ..... *H01Q 1/243* (2013.01); *H01Q 1/38* (2013.01); *H01Q 1/40* (2013.01); *H01Q 1/50* (2013.01)

(58) Field of Classification Search
CPC ..... H01Q 1/243; H01Q 1/36; H01Q 1/38; H01Q 1/50
(Continued)

(56) References Cited

U.S. PATENT DOCUMENTS

2012/0274148 A1* 11/2012 Sung ..... H04B 5/0037 307/104
2013/0076571 A1* 3/2013 Desclos ..... H01Q 1/243 343/700 MS

FOREIGN PATENT DOCUMENTS

KR 10-2010-0040417 A 4/2010
KR 10-2011-0007727 A 1/2011
(Continued)

OTHER PUBLICATIONS

International Search Report in International Application No. PCT/KR2014/002694, dated Nov. 21, 2014.

*Primary Examiner* — Graham Smith
(74) *Attorney, Agent, or Firm* — Park, Kim & Suh, LLC

(57) ABSTRACT

The present invention relates to an antenna radiator having heterogeneous antennas cross-linked with each other, and a manufacturing method therefor. More specifically, the present invention provides an antenna radiator having heterogeneous antennas cross-linked with each other, wherein the antenna radiator has an antenna pattern constituted with an in-mold antenna provided on an end of a frame, and a printed or plated antenna provided on an adjacent area to the in-mold antenna, the in-mold antenna having a protrusion on at least one area thereof, and the printed or plated antenna provided to overlap the protrusion such that the in-mold antenna and the printed or plated antenna are cross-linked with each other; and a manufacturing method for the antenna radiator.

7 Claims, 5 Drawing Sheets

(51) Int. Cl.
*H01Q 1/50* (2006.01)
*H01Q 1/40* (2006.01)

(58) Field of Classification Search
USPC ..... 343/702
See application file for complete search history.

(56) References Cited

FOREIGN PATENT DOCUMENTS

KR 10-2013-0051054 A 5/2013
KR 10-2013-0106213 A 9/2013

* cited by examiner (a)

(b)

ANTENNA RADIATOR HAVING HETEROGENEOUS ANTENNAS CROSS-LINKED WITH EACH OTHER AND MANUFACTURING METHOD THEREFOR

CROSS-REFERENCE TO RELATED APPLICATIONS

This application is the National Stage filing under 35 U.S.C. 371 of International Application No. PCT/KR2014/002694, filed on Mar. 28, 2014, which claims the benefit of Korean Patent Application No. 10-2014-0025698, filed on Mar. 4, 2014, the contents of which are all hereby incorporated by reference herein in their entirety.

TECHNICAL FIELD

The present invention relates to an antenna radiator having heterogeneous antennas cross-linked with each other, and a manufacturing method therefor. More specifically, the present invention provides an antenna radiator having heterogeneous antennas cross-linked with each other, wherein the antenna radiator has an antenna pattern constituted with an in-mold antenna provided on an end of a frame, and a printed or plated antenna provided on an adjacent area to the in-mold antenna, the in-mold antenna having a protrusion on at least one area thereof, and the printed or plated antenna provided to overlap the protrusion such that the in-mold antenna and the printed or plated antenna are cross-linked with each other; and a manufacturing method for the antenna radiator.

BACKGROUND ART

In recent years, various antennas built in mobile device casings, namely, built-in antennas and electronic device casings including the same, have been widely studied. At present, there are various antenna technologies such as in-mold antennas (press type), plated antennas (laser type), press assembled antennas (press assembly), printed antennas (print type), etc. that respectively have their own advantages and disadvantages.

A conventional in-mold antenna is generally mounted on a frame of a mobile communication device. The space between a feeding portion (electricity feeding portion) formed on a frame and a position in which the antenna pattern is formed, is completely sealed. In addition, since the pattern is not formed on the outermost portion of the frame, it is easy to form a new antenna pattern on the frame. However, in comparison with a technology in which the antenna pattern is formed at the outermost portion of the frame, the antenna pattern that is not formed on the outermost portion of the frame is close to the ground because the antenna pattern is formed inside of the frame. Therefore, it is difficult to obtain superior performances such as good reception sensitivity, radiation performance, etc. In addition, it is difficult at the development stage to modify the antenna pattern formed inside of the frame. That is, a total amount of the antenna pattern may be limited depending on the structure of the frame. Consequently, antenna performances are degraded as much as the antenna pattern is limited.

In addition, in the conventional plated antenna (laser type) or the printed antenna, the antenna pattern may be formed at the semi-outermost portion of the mobile device, but it is difficult to form the antenna pattern at the outermost portion of the mobile device.

In addition, the plated or printed antenna is configured such that a connecting part between the feeding portion and a point at which the antenna pattern starts is formed by plating. Therefore, a hole may occur at the connecting part, and thus it is difficult to seal the connecting part.

In the conventional press assembled antenna (press assembly), the antenna pattern may be formed at the semi-outermost and outermost portions of the mobile device. However, the antenna pattern is only formed at an area in which the antenna radiator is not exposed to the outside of the battery cover of the mobile communication device. Therefore, transmitting and receiving sensitivities are limited due to the small coverage of the antenna radiator. That is, the antenna radiator is typically only formed on an upper surface of a FPCB, and is not formed on a side surface that is not covered by the battery cover. Thus, there is a limitation in extending the size of the antenna radiator.

DISCLOSURE

Technical Problem

The present invention has been proposed to solve the problems in the related art. The present invention is intended to enable easy formation and modification of an antenna pattern.

In addition, the present invention is intended to reduce a rate of inferior goods, to enhance production yield, and to reduce manufacturing costs, in comparison with an antenna pattern only formed by LDS.

In addition, the present invention is intended to simplify a manufacturing process, in comparison with an antenna pattern that has only an in-mold antenna.

In addition, the present invention is intended to simultaneously obtain superior antenna performance and waterproof function by sealing the feeding portion having the in-mold antenna with an LDS antenna or a printed antenna.

In addition, the present invention is intended to obtain superior antenna performance of an antenna radiator while reducing manufacturing costs thereof.

Technical Solution

In order to achieve the above object, according to one aspect of the present invention, there is provided an antenna radiator having heterogeneous antennas cross-linked with each other, the antenna radiator including a frame on which the antennas are mounted; an in-mold antenna provided on an end of the frame, and having a protrusion on at least one area thereof; and a printed or plated antenna electrically connected to the in-mold antenna by overlapping the protrusion thereof.

The part on which the in-mold antenna is provided may be located at an outermost portion of a mobile device.

An additional in-mold antenna may be provided at a feeding portion of the frame, and the printed or plated antenna may be provided on the feeding portion to seal the feeding portion, thereby providing a waterproof function.

The additional in-mold antenna provided at the feeding portion of the frame may be in contact with a conductive part of a PCB by the conductive part protruding upwardly from the PCB, or by both the conductive part formed flat on the PCB, and the in-mold antenna extending downwardly.

The additional in-mold antenna may be attached to an outer surface of a projecting part, integrally formed with the frame, extending downwardly from the feeding portion, the feeding portion being sealed with the plate or printed antenna.

A first plated part may be formed on the additional in-mold antenna, and the plate or printed antenna may be provided on the first plated part.

The additional in-mold antenna may be in-molded such that a top surface thereof is lower than a top surface of the frame, and the first plated part may be plated such that a top surface thereof is level with the top surface of the frame, so the first plated part has a thickness equal to a height difference between levels of the top surfaces of the frame and the additional in-mold antenna.

In addition, according to another aspect, there is provided a manufacturing method for an antenna radiator having heterogeneous antennas cross-linked with each other, the manufacturing method including providing an in-mold antenna on a first side of a frame, the in-mold antenna having a protrusion; and providing a printed or plated antenna on a second side of the frame, wherein a portion of the printed or plated antenna overlaps the protrusion of the in-mold antenna.

An additional in-mold antenna may be provided at a feeding portion of the frame, and the printed or plated antenna may be provided to overlap the additional in-mold antenna formed at the feeding portion of the frame, thereby sealing the feeding portion.

Advantageous Effects

According to the described above, the present invention is expected to enable easy formation and modification of an antenna pattern.

In addition, the present invention is expected to reduce the rate of inferior goods, to enhance production yield, and to reduce manufacturing costs, in comparison with an antenna pattern only formed by LDS.

In addition, the present invention is expected to simplify the manufacturing process, in comparison with an antenna pattern that has only the in-mold antenna.

In addition, the present invention is expected to simultaneously obtain superior antenna performance and waterproof function by sealing the feeding portion having the in-mold antenna with the LDS antenna or the printed antenna.

In addition, the present invention is expected to reduce manufacturing costs of the antenna radiator, and to obtain superior antenna performance by securing a suitable distance between the ground and the antenna pattern.

BEST MODE

Figure 1:
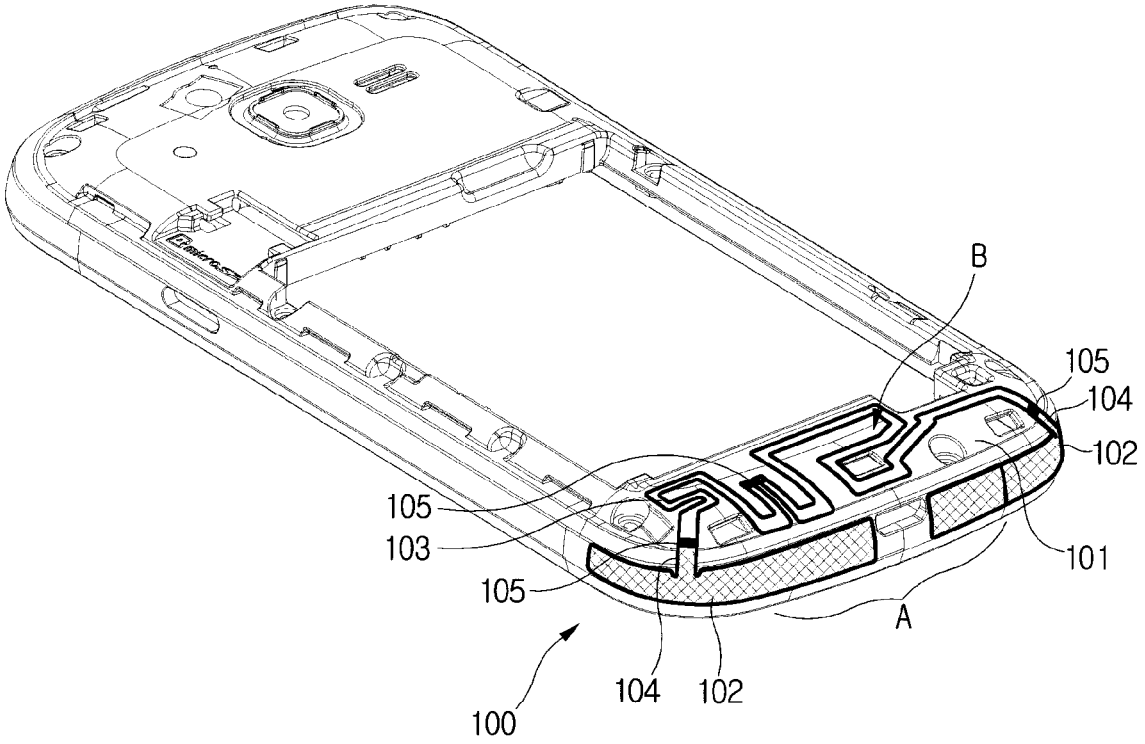
FIG. 1 is a perspective view showing a state in which both an in-mold antenna and a printed or plated antenna are formed in an according to an exemplary embodiment of the present invention.

Hereinafter, an exemplary embodiment of the present invention will be described in detail with reference to the accompanying drawings.

The present invention combines advantages of an in-mold antenna 102 and a printed or plated antenna 103. The in-mold antenna 102 can be inexpensively formed, and can be formed at the outermost portion of a frame 101. The printed or plated antenna 103 can be easily modified, and can secure a distance between the ground and the antenna pattern such that the performance of an antenna radiator 100 is superior. The antenna radiator 100 can obtain the best performance by combining the in-mold antenna and the printed or plated antenna.

In addition, in sealing a feeding portion 106, the feeding portion 106 can be sealed with only the in-mold antenna 102. However, the present invention enables the feeding portion 106 to be ultimately sealed with the printed or plated antenna 103 that is highly efficient as the antenna radiator 100. Therefore, the present invention can obtain two advantages such as superior performance and waterproof function, by only sealing with the printed or plated antenna.

Figure 2:
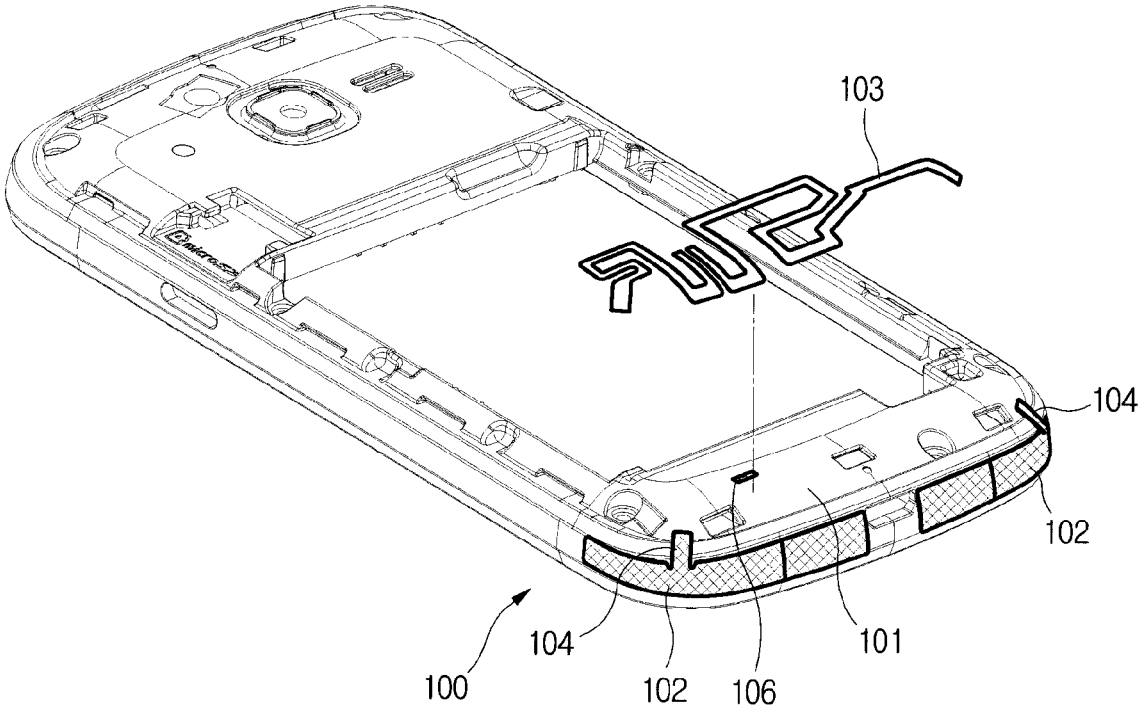
FIG. 2 is an exploded perspective view showing the printed or plated antenna of FIG. 1.
Figure 3:
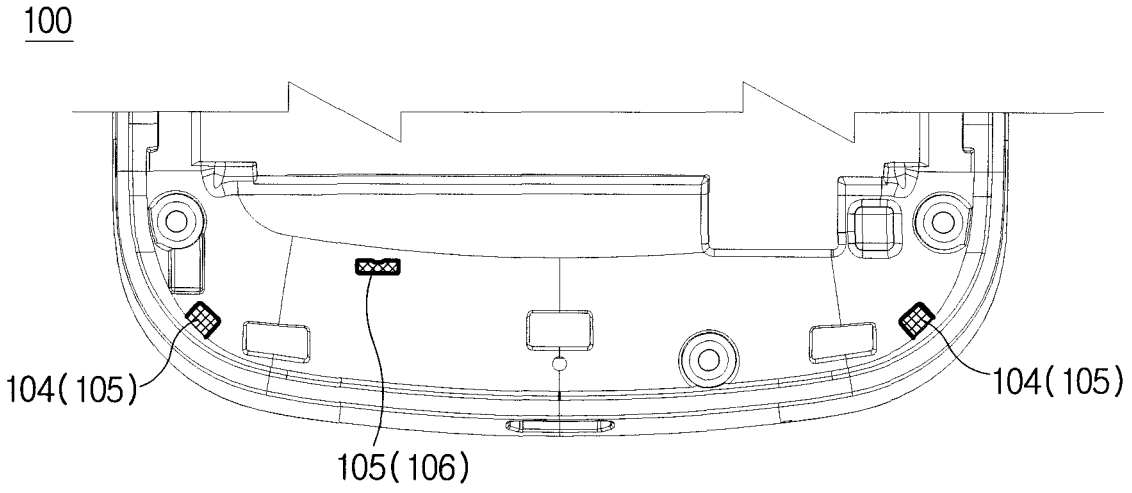
FIG. 3 is a top plan view showing in detail the antenna radiator according to the exemplary embodiment of the present invention.
Figure 3:
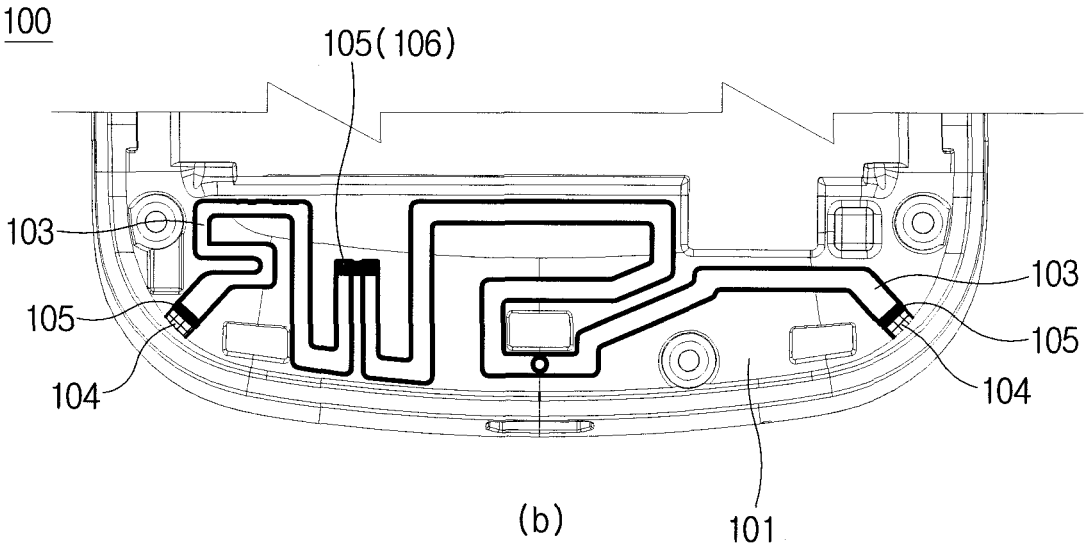

FIG. 1 is a perspective view showing a state in which both the in-mold antenna 102 and the printed or plated antenna 103 are formed in the antenna radiator 100 according to an exemplary embodiment of the present invention. FIG. 2 is an exploded perspective view showing the printed or plated antenna 103 of FIG. 1. FIG. 3 is a top plan view showing in detail the antenna radiator 100 according to the exemplary embodiment of the present invention.

As shown in the drawings, the antenna radiator 100 includes the frame 101 on which the antennas are mounted; the in-mold antenna 102 provided on an end of the frame 101, and having a protrusion 104 on at least one area thereof; and the printed or plated antenna 103 electrically connected to the in-mold antenna 102 by overlapping the protrusion 104 thereof.

The in-mold antenna 102 is made of metallic foil (copper foil is desirable) manufactured in advance, and is fixed to the frame 101 of a mobile communication device by a physical method (use of attaching unit, fixing unit, etc.). The printed or plated antenna 103 is mounted on the frame 101 by a method of printing or precipitating the printed or plated antenna on the frame 101 by using liquid metal, which is completely different from the physical method used to fix the in-mold antenna.

In a conventional method, it was common to use only an in-mold method or a printing or plating method. However, the present invention uses characteristics of both the in-mold method and of the printing or plating method, and thus, the present invention is completely different from the conventional method. In short, the present invention is the result of maximally using the advantages of the two methods.

Figure 4:
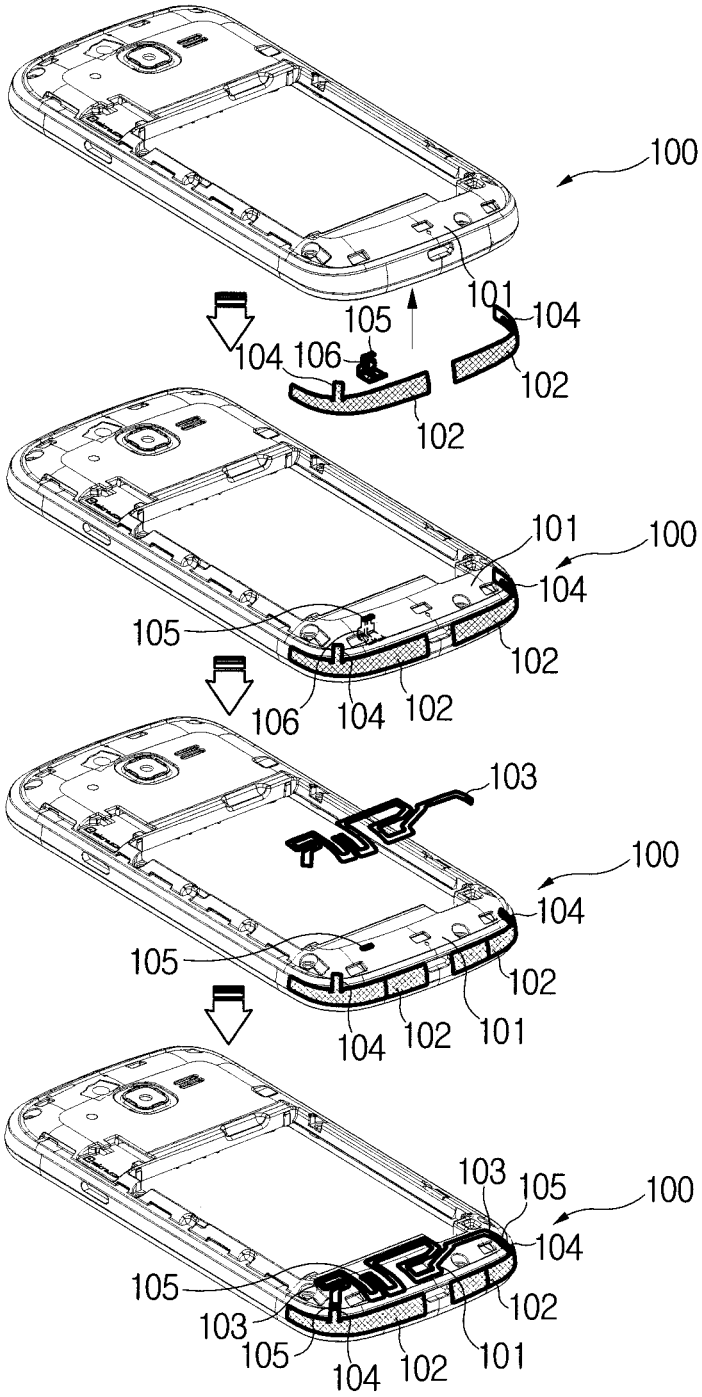
FIG. 4 is a view showing a process of forming an antenna radiator according to the exemplary embodiment of the present invention.

FIG. 4 is a view showing a process of forming the antenna radiator 100 according to the exemplary embodiment of the present invention. The process will be described below in detail.

First, the in-mold antenna 102 is mounted at the outermost portion (A) of the frame 101 of the mobile communication device (FIGS. 4*a* and 4*b*). The method of mounting the in-mold antenna 102 is done by a method of physically combining the frame 101 with an antenna. The combining method may use an attaching unit, a fixing unit, etc., and is well known in the art. Therefore, detailed descriptions thereof will be omitted. For reference, the area adjacent to the outermost portion (A) is defined as the semi-outermost portion (B).

Next, the printed or plated antenna 103 is formed at the semi-outermost portion (B) of the frame 101. The protrusion 104 is formed on at least one area of the in-mold antenna 102 to provide an overlapping portion 105 in which the protrusion overlaps the printed or plated antenna 103. That is, the in-mold antenna 102 is electrically connected to the printed or plated antenna 103 via the protrusion 104. In short, after mounting the in-mold antenna 102 at the outermost portion (A) of the frame 101 that is the outermost portion of the mobile communication device, the printed or plated antenna 103 is formed at the semi-outermost portion (B)(B) of the frame 101. At this moment, the printed or plated antenna is formed on the protrusion 104 to overlap the protrusion (FIGS. 4*c* and 4*d*).

In the meantime, the feeding portion 106 is provided at the frame 101 to electrically connect the PCB with an antenna that is formed on the frame 101. The feeding portion 106 includes a path in which the antenna is inserted into, the antenna penetrating the frame 101 to be in contact with the PCB. Therefore, water may permeate via the feeding portion 106, such that it is difficult to provide waterproof function.

The present invention can obtain another advantage by enabling the antenna radiator 100 to seal the feeding portion 106. After sealing the feeding portion 106 with the in-mold antenna 102, the printed or plated antenna 103 overlaps the in-mold antenna 102 thereon to form the antenna pattern. Therefore, it is possible to electrically connect the in-mold antenna to the PCB via the feeding portion 106, and to provide the waterproof function. The PCB is electrically connected with the in-mold antenna 102, and the feeding portion 106 is sealed with the printed or plated antenna 103 (FIG. 3).

Figure 5:
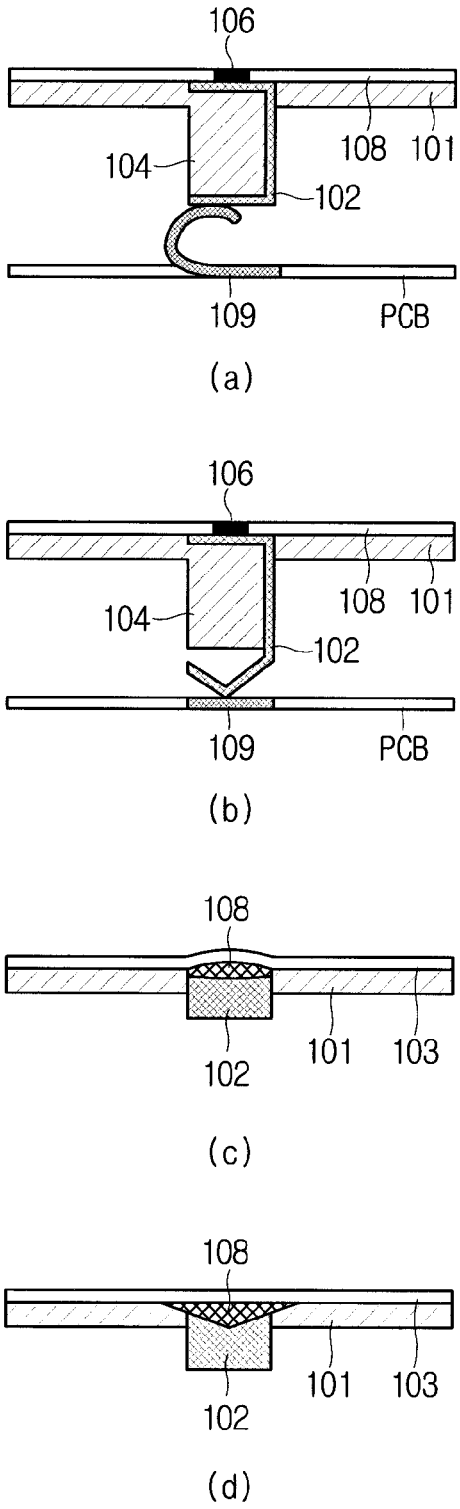
FIG. 5 is a view showing a shape of an in-mold antenna and showing a structure of combination of the in-mold antenna and the printed or plated antenna according to the exemplary embodiment of the present invention.

FIG. 5 is a view showing a shape of the in-mold antenna 102 and showing a structure of combination of the in-mold antenna 102 and the printed or plated antenna according to the exemplary embodiment of the present invention.

As shown in FIG. 5*a*, after forming the in-mold antenna 102 at the feeding portion 106 of the frame 101, the in-mold antenna 102 is in contact with a conductive part 109 of the PCB. The conductive part 109 protrudes upwardly from the PCB to be in contact with the in-mold antenna 102. The conductive part 109 may be a C-clip as shown in the drawing, without being limited thereto. The in-mold antenna 102 formed at the feeding portion 106 is covered with the printed or plated antenna 103.

In the mean time, a projecting part 107 is provided at the frame 101, the projecting part integrally formed with the frame 101 and extending downwardly from the feeding portion 106. The in-mold antenna 102 is attached to an outer surface of the projecting part 107. There is a gap having a slit shape between the feeding portion 106 and the projecting part 107. The gap is sealed by the thickness of the in-mold antenna 102, and by covering the feeding portion 106 with the printed or plated antenna 103.

The in-mold antenna 102 of FIG. 5*b* further extends downwardly, in comparison with that of FIG. 5*a*, to be in contact with the top surface of the PCB. Therefore, the conductive part may be formed flat on the PCB without controlling or forming the shape of the conductive part. It is desirable to form the shape of the lower part of the in-mold antenna 102 as that of the drawing, without being limited thereto. In addition, when forming the in-mold antenna 102 as that of FIG. 5*b*, the in-mold antenna may have elasticity, and thus, may be in elastic contact with the PCB.

In FIGS. 5*c* and 5*d*, the projecting part 107 of FIGS. 5*a* and 5*b* is not provided at the frame 101. Since the feeding portion 106 is penetrated, the in-mold antenna 102, which is bulk-type, is fixed to the feeding portion 106 in advance by being matched to the diameter of the feeding portion 106. Alternatively, the in-mold antenna 102, which is bulk-type, is manufactured by an insert molding process. After forming a first plated part 108 on the in-mold antenna 102, the printed or plated antenna 103 is formed on the first plated part 108, thereby manufacturing the antenna radiator 100. The top surface of the in-mold antenna 102 of FIG. 5*d* is much lower in height than the top surface of the frame 101, in comparison with that of FIG. 5*c*, and thus, the first plated part can be thicker. It is desirable to form the top surface of the first plated part to be level with the top surface of the frame 101. Therefore, it is possible to maintain the upper portion of the printed or plated antenna 103 flat, and to better secure the thickness of the first plated part downwardly, thereby enhancing the performance of the antenna radiator 100.

In this case, even though the frame 101 is thin, the electricity feeding structure of the antenna manufactured by the insert molding process can be formed to be sufficiently thick, thereby stably feeding electricity. In the meantime, it is possible to obtain sufficient antenna performance by the printed or plated antenna 103 as well as waterproof function. Consequently, the present invention has various advantages.

Though the exemplary embodiment in the present invention has been described in detail, the present invention can be variously modified to be carried out without departing from the scope of the technical idea of the present invention, and is thus not limited to these examples. Accordingly, the exemplary embodiment described herein is for illustrative rather intended to limit the technical scope of the present invention, it is not the scope of the present invention by this exemplary embodiment stabilized. The scope of the invention should be construed by the following claims, and all spirits within the scope will be construed as being included in the scope of the invention.

The invention claimed is:

1. An antenna radiator having heterogeneous antennas cross-linked with each other, the antenna radiator comprising:

a frame on which the antennas are mounted;

an in-mold antenna provided on an end of the frame, and having a protrusion on at least one area thereof; and a printed or plated antenna electrically connected to the in-mold antenna by overlapping the protrusion thereof, wherein an additional in-mold antenna is provided at a feeding portion of the frame, and the printed or plated antenna is provided on the feeding portion to seal the feeding portion, thereby providing a waterproof function.

2. The antenna radiator of claim 1, wherein the part on which the in-mold antenna is provided is located at an outermost portion of a mobile device.

3. The antenna radiator of claim 1, wherein the additional in-mold antenna provided at the feeding portion of the frame is in contact with a conductive part of a PCB by the conductive part protruding upwardly from the PCB, or by both the conductive part formed flat on the PCB, and the in-mold antenna extending downwardly.

4. The antenna radiator of claim 3, wherein the additional in-mold antenna is attached to an outer surface of a projecting part, integrally formed with the frame, extending downwardly from the feeding portion, the feeding portion being sealed with the plate or printed antenna.

5. The antenna radiator of claim 3, wherein a first plated part is formed on the additional in-mold antenna, and the plate or printed antenna is provided on the first plated part.

6. The antenna radiator of claim 5, wherein the additional in-mold antenna is in-molded such that a top surface thereof is lower than a top surface of the frame, and the first plated part is plated such that a top surface thereof is leveled with the top surface of the frame, so the first plated part has a thickness equal to a height difference between levels of the top surfaces of the frame and the additional in-mold antenna.

7. A manufacturing method for an antenna radiator having heterogeneous antennas cross-linked with each other, the manufacturing method comprising:

providing an in-mold antenna on a first side of a frame, the in-mold antenna having a protrusion; and providing a printed or plated antenna on a second side of the frame, wherein a portion of the printed or plated antenna overlaps the protrusion of the in-mold antenna, wherein an additional in-mold antenna is provided at a feeding portion of the frame, and the printed or plated antenna is provided to overlap the additional in-mold antenna provided at the feeding portion of the frame, thereby sealing the feeding portion.

* * * * *